US010293841B2

(12) United States Patent
Hammerl et al.

(10) Patent No.: US 10,293,841 B2
(45) Date of Patent: May 21, 2019

(54) DEVICE AND METHOD FOR RAIL-SIDE MONITORING OF THE POSITION OF STABLED RAIL-BASED VEHICLE

(71) Applicant: SIEMENS MOBILITY GMBH, Munich (DE)

(72) Inventors: Malte Hammerl, Braunschweig (DE); Jacob Johannes Kohlruss, Braunschweig (DE); Andreas Steingroever, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 235 days.

(21) Appl. No.: 15/025,958

(22) PCT Filed: Sep. 4, 2014

(86) PCT No.: PCT/EP2014/068793

§ 371 (c)(1),
(2) Date: Mar. 30, 2016

(87) PCT Pub. No.: WO2015/043904

PCT Pub. Date: Apr. 2, 2015

(65) Prior Publication Data

US 2016/0214631 A1 Jul. 28, 2016

(30) Foreign Application Priority Data

Sep. 30, 2013 (DE) ..... 10 2013 219 812

(51) Int. Cl.
*B61L 23/04* (2006.01)
*B61L 25/02* (2006.01)

(52) U.S. Cl.
CPC ..... *B61L 25/025* (2013.01); *B61L 25/021* (2013.01); *B61L 23/041* (2013.01)

(58) Field of Classification Search
CPC ..... B61L 25/025; B61L 25/021; B61L 23/041
See application file for complete search history.

(56) References Cited

U.S. PATENT DOCUMENTS 5,129,605 A * 7/1992 Burns ..... B61L 25/021 246/122 R
6,597,987 B1 * 7/2003 Barton ..... G01C 21/30 340/988
6,631,322 B1 * 10/2003 Arthur ..... B61L 27/0027 340/991

(Continued)

FOREIGN PATENT DOCUMENTS

CN 101020465 A 8/2007
CN 102129785 A 7/2011

(Continued)

*Primary Examiner* — Jason C Smith
(74) *Attorney, Agent, or Firm* — Laurence Greenberg; Werner Stemer; Ralph Locher

(57) ABSTRACT

A device for infrastructure-side monitoring of a position of a stabled rail-based vehicle includes a detector for infrastructure-side detection of a change of location of the stabled vehicle and a communications entity or device configured to communicate the detected change in location over a communications network to a user of the communications network. A corresponding method, a corresponding system, a method for operating the system and a computer program product are also provided.

8 Claims, 2 Drawing Sheets

(56) References Cited

U.S. PATENT DOCUMENTS

| | | | | |
|---|---|---|---|---|
| 8,190,312 | B2 * | 5/2012 | Nandedkar | B61L 25/021 701/19 |
| 9,862,396 | B2 * | 1/2018 | Nandedkar | B61L 25/021 |
| 2004/0140405 | A1 * | 7/2004 | Meyer | B61L 25/021 246/122 R |
| 2005/0065726 | A1 * | 3/2005 | Meyer | B61L 25/021 701/470 |
| 2012/0232726 | A1 * | 9/2012 | Nandedkar | B61L 25/021 701/19 |
| 2015/0088345 | A1 * | 3/2015 | Nandedkar | B61L 25/021 701/20 |
| 2015/0291193 | A1 * | 10/2015 | Perras | B61L 25/025 246/122 R |
| 2016/0214631 | A1 * | 7/2016 | Hammerl | B61L 25/021 |
| 2016/0318531 | A1 * | 11/2016 | Johnson | B61L 25/02 |

FOREIGN PATENT DOCUMENTS

| | | | |
|---|---|---|---|
| CN | 202624275 | U | 12/2012 |
| CN | 203134116 | U | 8/2013 |
| DE | 102010061878 | A1 | 5/2012 |
| EP | 0989408 | A1 | 3/2000 |
| EP | 1897780 | A2 | 3/2008 |
| FR | 2952456 | A1 | 5/2011 |
| WO | 2012069325 | A1 | 5/2012 |

* cited by examiner

DEVICE AND METHOD FOR RAIL-SIDE MONITORING OF THE POSITION OF STABLED RAIL-BASED VEHICLE

BACKGROUND OF THE INVENTION

Field of the Invention

The invention relates to a device and a method for rail-side monitoring of a position of a stabled rail-based vehicle. The invention further relates to a system for rail-side monitoring of a position of a stabled rail-based vehicle and to a method for operating said system. The invention further relates to a computer program.

After stabling a rail-based vehicle, unnecessary loads, including the vehicle control unit for automatic train operation, are normally turned off. Therefore the information relating to the location at which the vehicle was stabled is usually lost to the vehicle control unit, for example. Residual storage of the location information in the vehicle control unit is only permitted if it can be guaranteed that the vehicle will not be moved due to external intervention, for example. When the vehicle control unit is turned on when restarting the vehicle, there is consequently no provision for location-finding of the vehicle, i.e. the location of the vehicle is not known.

However, this information is advantageous for automatic train operation in particular, since the vehicles can then commence an automatic train run at full working capacity directly after a restart, without requiring e.g. an initialization run for location-finding of the vehicle. The position of the vehicle is usually specified with an accuracy in the meter range or decimeter range, and with a resolution of centimeters in this case.

It is actually possible for the vehicle control unit to remain switched on, such that it retains in its memory the information relating to the position or location at which the vehicle was stabled. A vehicle control unit which is switched on nonetheless requires power, which must usually be provided by a vehicle battery. However, a vehicle battery can only provide limited energy for the vehicle control unit, and therefore the vehicle control unit can only operate for a certain number of hours during which it can guarantee correct location-finding of the vehicle.

There is consequently a requirement to be able to completely switch off a vehicle and its vehicle control unit, and be able to return to automatic operation after an indeterminate downtime. For this purpose, it is however necessary to establish whether, after stabling the vehicle and switching off all loads including the vehicle control unit, the vehicle has moved, i.e. whether its position or its location has changed relative to the location at which the vehicle was stabled. A known method makes use of existing or specific track vacancy detection equipment for this purpose. However, this only makes it possible to establish whether the vehicle is situated in a stopping position that is predetermined by the track vacancy detection equipment. In this case, the method restricted to specific train lengths and vehicle types with their specific axial clearances. The accuracy is limited to a few meters in this case.

BRIEF SUMMARY OF THE INVENTION

The object of the invention can therefore be considered to be that of providing a device which overcomes the known disadvantages and allows a rail-based vehicle to return to automatic train operation immediately after being switched on again.

The object of the invention can also be considered to be that of providing a corresponding method, a corresponding system, a corresponding method for operating the system, and a computer program.

These objects are achieved by the respective subject matter of the independent claims. Advantageous embodiments are the subject matter of dependent subclaims in each case.

According to an aspect of the invention, a device for infrastructure-side monitoring of a position of a stabled rail-based vehicle is provided, said device comprising a detector for infrastructure-side detection of a change in location of the stabled vehicle and a communication entity which is designed to communicate the detected change in location via a communication network to a user of said communication network.

The information relating to the change in location may contain, for example, solely the binary information that the location has changed or not, and/or the relative value of the location change with a resolution in the centimeter or decimeter range, and/or the absolute value as a distance between sensor and vehicle.

According to a further aspect, a method for infrastructure-side monitoring of a position of a stabled rail-guided vehicle is provided, said method comprising the following steps: infrastructure-side detection of a location change of the stabled vehicle, and communication of a detected location change via a communication network to a user of said communication network.

According to a further aspect, a system for infrastructure-side monitoring of a position of a stabled rail-based vehicle is provided, said system comprising the inventive device and the user.

According to a further aspect, a method for operating the inventive system is provided, wherein the detector detects the location change from the infrastructure side, and communicates the detected location change to the user via the communication network by means of the communication entity.

According to a further aspect, a computer program is provided, comprising program code for performing the inventive method when the computer program is executed in a computer.

The invention therefore includes in particular the idea of monitoring whether the rail-based vehicle has moved or not, wherein said monitoring is not performed in the vehicle itself, i.e. internally in the vehicle. Instead, provision is inventively made for monitoring externally, i.e. from the infrastructure side, in particular the rail side, whether the vehicle has moved or not. By virtue of the infrastructure-slide, preferably rail-side, monitoring by the detector, which can detect from the rail side whether the stabled vehicle has moved or not, a vehicle control unit no longer has to remain switched on in the vehicle itself for the purpose of location-finding. Consequently, a vehicle battery no longer has to supply energy for the purpose of operating the vehicle control unit. It is therefore advantageously possible, even after an indiscriminate downtime of the stabled vehicle, reliably to establish whether the location or the position (location and position are used synonymously in the context of this description) of the stabled vehicle has changed or not. By virtue of providing a communication entity, a detected change in location can advantageously be communicated to a user of a communication network. The information indicating that a stabled vehicle has moved or not is therefore available to a third party. On the basis of this information, the third party can then decide in particular what measure to take.

The term "infrastructure-side" as used in the context of this description should in each case be understood also to signify the term "rail-side" and vice versa.

The term "rail-side" (or "infrastructure-side") in the sense of the present invention signifies in particular "from the rail" (or "from an infrastructure", which is usually situated in the vicinity of the vehicle; the infrastructure can therefore be the rail, for example) and therefore signifies in particular that the monitoring and the detection are not performed internally in the vehicle itself, but externally instead, i.e. separately from the vehicle. Rail-side monitoring and rail-side detection are therefore performed externally relative to the vehicle. This therefore means in particular that the device comprising the detector and the communication entity are arranged externally relative to the vehicle, preferably in the vicinity of the rail. In this case, the vicinity of the rail signifies a region which is e.g. 100 m distant from the rail, in particular 10 m, preferably 5 m, and in particular less than 100 m. The stopping position of the vehicle in this case is preferably not limited to a narrow region but is flexible within certain limits. A narrow region may be e.g. a yard or a railway station or a stabling track. This is in contrast with a flexible region such as e.g. the whole line section, i.e. in particular a line section between railway stations or yards.

An element which is provided externally relative to the vehicle may be designated in particular as an infrastructure-side or rail-side or line-side or track-side element. An element which is provided in the vehicle, i.e. internally relative to the vehicle, and is therefore an element of the vehicle itself may be designated in particular as a vehicle-side element.

The rail-based vehicle may be a train, a carriage, a multiple unit or a locomotive, for example. The term "track" may also be used instead of rail, for example.

According to an embodiment, the user may be a rail-side apparatus of an automatic train protection system. Such an automatic train protection system comprises in particular a vehicle-side apparatus and a track-side apparatus. Both apparatuses communicate with each other, wherein the vehicle-side apparatus is able to control the vehicle independently of an operator on the basis of information from the track-side apparatus in order to brake or stop the vehicle in a hazardous situation, for example.

According to an embodiment, the detector may have a sensor entity for registering the vehicle and a sensor control unit for controlling the sensor entity, in order to register the vehicle multiple times in temporal succession, wherein the detector also comprises a processing entity which is designed to determine the change in location on the basis of sensor images corresponding to the vehicle that has been registered multiple times.

According to a further embodiment, for the stabled vehicle may be registered multiple times in temporal succession, wherein the change in location is determined on the basis of sensor images which correspond to the vehicle that has been registered multiple times.

This therefore means in particular that a comparison is made between a sensor image and one or more sensor images which were generated or recorded temporally before the sensor image. If the vehicle has not moved, it will not usually be possible to identify any difference in the sensor images. However, if the vehicle has moved, this can advantageously be identified as a difference in the sensor images. The sensor images can therefore be analyzed for differences by means of suitable image recognition methods, for example, such that possible differences can easily be recognized accordingly.

According to an embodiment, the sensor entity may have at least one sensor selected from the following group of sensors: radar sensor, ultrasound sensor, infrared sensor, and optical image sensor.

A sensor in the context of the present invention comprises a transmitter and a receiver in particular. Depending on the selected sensor, the transmitter emits the corresponding signal or the corresponding radiation in the direction of the vehicle. Correspondingly, the receiver is designed to receive a signal that is reflected by the vehicle.

This therefore means in particular that the transmitter transmits its signal or radiation to the vehicle, i.e. it directs its signal or radiation at the vehicle. At least part of the directed radiation or signal is reflected back towards the receiver, which can receive or detect the reflected signal or reflected radiation.

This therefore means in particular that the radar sensor has a radar transmitter and a radar receiver. A radar sensor therefore emits radar radiation and can detect reflected radar radiation. A radar sensor therefore generates radar images.

An ultrasound sensor therefore has in particular an ultrasound transmitter and an ultrasound receiver. Correspondingly, the ultrasound transmitter transmits an ultrasound signal or an ultrasound wave in the direction of the vehicle. Correspondingly, the ultrasound receiver can receive the reflected ultrasound wave or the reflected ultrasound signal. An ultrasound sensor therefore generates ultrasound images.

Exceptionally, an infrared sensor in particular may comprise solely an infrared receiver or detector. Such a receiver or detector detects infrared radiation which is radiated by the vehicle. An infrared sensor therefore generates infrared images.

Exceptionally, an optical image sensor in particular may comprise solely a receiver for light, such that images of the vehicle can be generated. An optical image sensor may be a sensor of a video camera, for example. An optical image sensor therefore generates images. A sensor of a video camera therefore generates video images.

According to a further embodiment, a detector control unit may be provided for controlling the detector, wherein the communication entity is so designed as to receive a detector control command via the communication network and forward it to the detector control unit, such that the detector control unit can control the detector on the basis of the received detector command.

According to a further embodiment, the rail-side detection may be performed as a function of a detector control command which is received via the communication network.

Control of the detector is therefore advantageously possible. In particular, the user of the communication network is able to control the detector via the communication entity. Control of the detector comprises in particular activation of the detector such that it is able to perform the rail-side detection of the change in location. Control of the detector comprises in particular deactivation of the detector, i.e. switching off. Consequently, the detector does not have to be continuously operational, for example if there is temporarily no stabled vehicle which has to be monitored. This can advantageously save electrical energy.

According to an embodiment, the communication entity may be so designed as to communicate the detected change in location to the user via the communication network automatically.

According to a further embodiment, the detected change in location may be communicated to the user automatically.

As a result of the detected change in location being communicated to the user automatically, the user does not have to deliberately initiate an enquiry to the device. An enquiry step is therefore unnecessary. In particular, provision may be made for the communication entity to communicate the relevant information to the user directly after the detection of the change in location. In this context, directly means in particular that a period of only approximately 10 s should elapse after the detection of the change in location, e.g. 5 s, in particular 1 s, and in particular less than 1 s. Therefore the information that the vehicle has moved is immediately and directly available to the user. The user can react quickly to this information correspondingly. Possible complications resulting from a change in location of the vehicle can therefore be quickly counteracted.

According to an embodiment, the communication entity may be so designed as to communicate the detected change in location to the user via the communication network in response to a corresponding enquiry from the user.

According to a further embodiment, the detected change in location may be communicated to the user in response to a corresponding enquiry from the user.

In this case, the user has to ask the device whether the location of the vehicle has changed relative to the original location. However, since the user itself can select the time of the enquiry, it is advantageously possible to ensure that the user is also ready to process the information from the device.

According to an embodiment, the communication entity may be so designed as to communicate the detected change in location to the user via the communication network automatically, and furthermore so designed as to communicate the detected change in location to the user via the communication network in response to a corresponding enquiry from the user. In particular, the communication entity may be switched between these two operating modes correspondingly. This may be done according to need and situation. It is therefore advantageously possible to adapt to a specific situation in an optimal manner.

This therefore means in particular that, according to a further embodiment, the detected change in location may be communicated to the user automatically or the detected change in location may be communicated to the user in response to a corresponding enquiry from the user, depending on an environmental parameter. Such an environmental parameter describes e.g. one or more current environmental conditions: e.g. weather, temperature, time of day, date, visibility, humidity.

According to an embodiment, the device may comprise a detector control unit for controlling the detector, wherein the communication entity is designed to receive a detector control command via the communication network and forward said command to the detector control unit such that the detector control unit can control the detector on the basis of the received detector command, wherein the user is designed to register a stabling of the vehicle and to send a detector control command to the device in response to said registration in order to activate the detector.

For this purpose, the detector may be in a standby mode from which it can be woken up by means of the detector control command.

According to an embodiment, the user may be so designed as to store a momentary location of the vehicle in response to said registration and, if there is no change in location of the vehicle, to transmit the stored location to a vehicle-side vehicle control unit when the latter is activated in order to restart the vehicle.

According to a further embodiment, the user may be so designed as to assign a code to the vehicle in response to the communicated detected change in location, said code indicating that the vehicle has been moved.

This therefore means in particular that the user assigns a code to the vehicle in response to the communicated detected change in location, said code indicating that the vehicle has been moved. Consequently, an operator can recognize this and adopt suitable measures in order to ensure that the vehicle can be assigned a position or a location again. For example, the operator can perform a location-finding run with the vehicle, e.g. by passing two balises. Such balises are usually arranged in the region of the rail or the track.

According to an embodiment, the communication entity comprises a transmitter and receiver for transmitting and receiving messages which are communicated via the communication network. Messages include e.g. detector control commands, enquiries to the device, and information indicating whether the vehicle has moved or not.

According to an embodiment, the vehicle comprises a radar reflector, in particular a passive or an active radar reflector, which is arranged on an outer surface of the vehicle. This advantageously has the effect that a preferred reflection of radar radiation can be effected in this region. The quality of a radar receive signal is advantageously improved thus. It is thereby advantageously possible in unfavorable environmental conditions to distinguish more effectively between vehicle movements on the stabling track under observation and irrelevant changes such as falling leaves, people on the track or train movements on the adjacent track, for example.

According to an embodiment, the detector is so configured as to register or detect an orientation of the vehicle. This information can be communicated to the user via the communication network by means of the communication entity in particular. In particular, this may take place automatically and/or preferably following a corresponding enquiry. An orientation of the vehicle indicates in particular where a front end (nose) and a back end (tail) of the vehicle are located. In particular, an orientation is defined relative to the guide provided by the rail, i.e. to the direction specified by the rail.

BRIEF DESCRIPTION OF THE SEVERAL VIEWS OF THE DRAWING

The properties, features and advantages of this invention as described above, and the way in which these are achieved, are made clearer and more readily understandable in the context of the following description of the exemplary embodiments, these being explained in greater detail in connection with the drawings, in which.

DESCRIPTION OF THE INVENTION

Identical reference signs may be used for identical features in the following.

Figure 1:
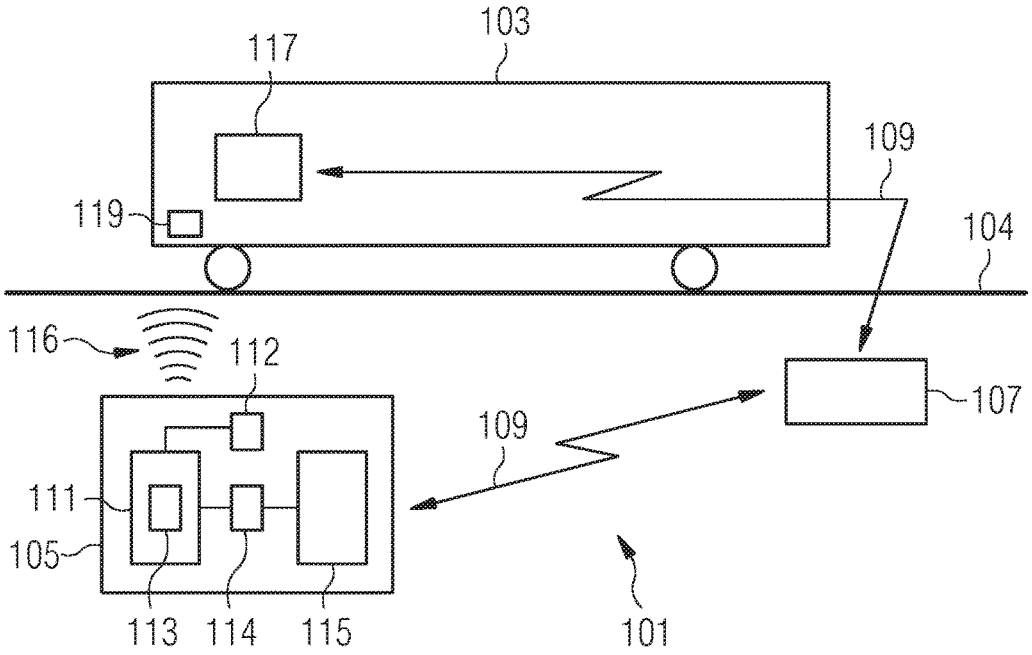
FIG. 1 shows a system for infrastructure-side monitoring of a position of a stabled rail-based vehicle.

FIG. 1 shows a system 101 for infrastructure-side monitoring of a position of a stabled rail-based vehicle 103.

In the present exemplary embodiment, the vehicle 103 is a train. This train is guided and stabled on a rail 104.

The system 101 comprises a device 105 for infrastructure-side monitoring of a position of the stabled rail-based vehicle 103. The system 101 also comprises a user 107. The user 107 is an infrastructure-side part of an automatic train protection system.

The device 105 and the user 107 can communicate via a communication network 109. This is illustrated symbolically by means of a jagged duel-headed arrow.

The device 105 comprises a detector 111 for infrastructure-side detection of a change in location of the stabled vehicle 103. The detector 111 comprises a radar sensor 113, which can emit and receive radar radiation 116. The emitted radar radiation is indicated symbolically by the reference sign 116. The radar radiation 116 is at least partly reflected by the vehicle 103. The reflected radar radiation can be received by the radar sensor 113. For the sake of clarity, the radar radiation reflected by the vehicle 103 is not shown.

The device 105 further comprises a detector control unit 114 for controlling the detector 111.

The device 105 further comprises a communication entity 115 which is designed to communicate a detected change in location via the communication network 109 to the user 107 of the communication network 109.

The communication entity 115 comprises a transmitter (not shown) and a receiver (not shown) for transmitting and receiving messages which are communicated via the communication network 109.

The device 105 further comprises a processing entity 112 which is designed to determine the change in location on the basis of sensor images, radar images in this case, corresponding to the vehicle 103 which has been registered multiple times.

The vehicle 103 comprises a vehicle control unit 117 which, together with the user 107, forms part of the automatic train protection system. The vehicle control unit 117 and the user 107 can likewise communicate via the communication network 109. This communication is also identified symbolically by means of a jagged dual-headed arrow having the reference sign 109.

The vehicle 103 comprises a passive radar reflector 119, which is arranged on an outer surface of the vehicle 103. This advantageously has the effect that a preferred reflection of radar radiation 116 can be effected in this region. The quality of a radar receive signal is advantageously improved thus. It is thereby advantageously possible in unfavorable environmental conditions to distinguish more effectively between vehicle movements on the stabling track under observation and irrelevant changes such as falling leaves, people on the track or train movements on the adjacent track, for example.

In an exemplary embodiment which is not shown, the device 105 without the user 107 and without the vehicle 103 is shown as such and is thus disclosed.

Figure 2:
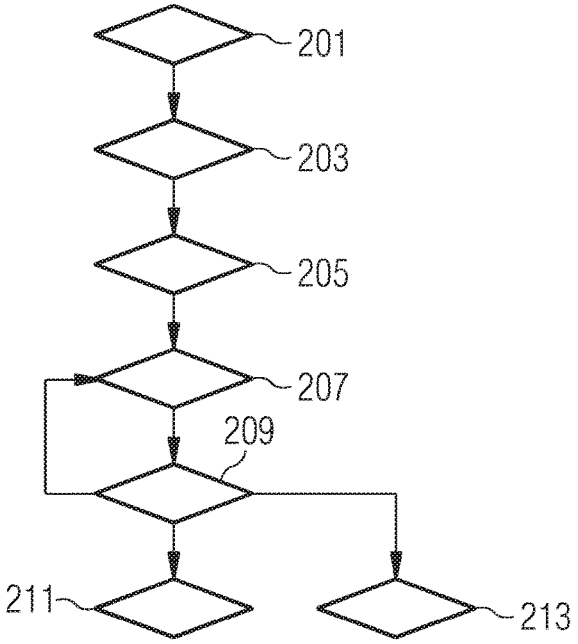
FIG. 2 shows a flow diagram of a method for operating the system according to FIG. 1.

FIG. 2 shows a flow diagram of a method for operating the system 101 according to FIG. 1.

In a step 201, the user 107 registers a stabling of the vehicle 103. Following thereupon, in a step 203 the user 107 stores a position or a location and an orientation of the vehicle 103. In a step 205, the user 107 transmits a detector control command to the device 105 via the communication network 109.

The transmitted detector control command is received by the communication device 115 and forwarded to the detector control unit 114. This activates the radar sensor 113 accordingly, such that the radar sensor 113 emits radar radiation 116 and receives reflected radar radiation.

The device 105 therefore commences the infrastructure-side monitoring of the vehicle 103. As part of this activity, the vehicle 103 is registered multiple times in temporal succession by means of the radar radiation 116 and corresponding sensor images are generated. The processing entity 112 compares a momentary radar image with a previous radar image. The registration of the vehicle 103 and the generation of a sensor image take place in a step 207. The comparison takes place in a step 209.

If a difference between the momentary radar image and a previous radar image is identified in the step 209, this indicates that the vehicle 103 has been moved. To this extent, a change in location of the vehicle 103 is detected. According to a step 211, the detected change in location is automatically communicated to the user 107 by the device 105. As a result of this, the user 107 can e.g. assign a code to the vehicle 103, said code indicating that the vehicle has been moved. By this means, an operator is advantageously made aware that a location-finding run must be performed with the vehicle 103. For this purpose, the vehicle 103 may be run past two balises which are arranged along the rail 104, for example.

If no change in location is detected in the step 209, it is accordingly not possible to transmit a detected change in location to the user 107. If the user 107 registers that the vehicle is switched on again, i.e. started, the user 107 knows, by virtue of not having received a detected change in location, that the vehicle 103 has not been moved. In a step in 213, the user 107 sends the stored position or the stored location and the orientation to the vehicle control unit 117. As a result of this, the vehicle 103 is advantageously made aware of its momentary position or its momentary location. This is advantageously possible without the need for a vehicle battery (not shown).

Figure 3:
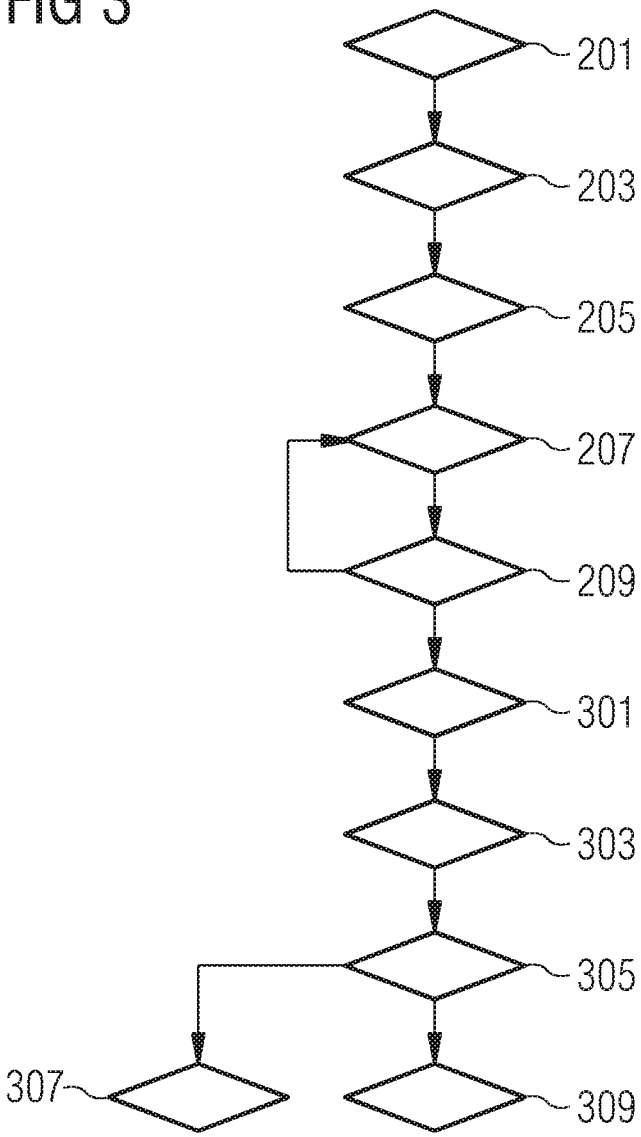
FIG. 3 shows a flow diagram of a further method for operating the system according to FIG. 1.

FIG. 3 shows a flow diagram of a further method for operating the system 101 according to FIG. 1.

Up to and including the step 209, the method according to FIG. 3 is similar to the method according to FIG. 2.

The method according to FIG. 3 differs in that a detected change in location is not transmitted to the user 107 automatically. Instead, the information that a change in location has been detected is stored in the device 105 itself in a step 301. For this purpose, the device 105 has a memory (not shown).

In a step 303, the user 107 registers that the vehicle 103 has been turned on again. In a step 305, the user 107 thereupon asks the device 105 whether a change in location of the vehicle 103 has been detected.

In response to the enquiry, the device 105 transmits information to the user 107, indicating whether the vehicle 103 has moved or not. If no change in location has been detected, the user 107 transmits the stored position or the stored location and the orientation to the vehicle control unit 117 in a step 307.

If a change in location was detected, however, the user 107 sets a code in a step 309. This therefore means in particular that the user 107 assigns a code to the vehicle 103, said code indicating that the vehicle 103 has moved. A location-finding run may then be performed as described in connection with FIG. 2.

In summary, the invention therefore includes in particular the idea of providing an infrastructure-side device which continuously monitors a stabling track by means of radar radiation and/or other contactless sensor imaging technologies, evaluates the received signal image, and reports any change in location that has been detected to a line-side apparatus of an automatic train protection system. To this end, provision is made for e.g. a radar transmitter and a radar receiver which are installed or arranged in the vicinity of a stabling track. In particular, provision is made for a processing entity which continuously compares a received signal image with the previous signal images and identifies a change in location of the stabled vehicle. Provision is preferably made for an input unit and an output unit of a communication entity, i.e. a transmitter and a receiver, for the purpose of communicating with the line-side apparatus of the automatic train protection system.

It is thereby possible advantageously to detect even a slight change in location of several centimeters resulting from an erroneous collision of a second train unit or due to towing away by another vehicle.

Although the invention is illustrated and described in detail with reference to the preferred exemplary embodiments, it is not restricted by the examples disclosed herein, and other variations may be derived therefrom by a person skilled in the art without thereby departing from the scope of the invention.

The invention claimed is:

1. A device for infrastructure-side monitoring of a position of a stabled rail-based vehicle, the device comprising:

a detector for infrastructure-side detection of a change in location of the stabled rail-based vehicle; and a communication entity configured to communicate the detected change in location over a communication network to a user of the communication network;

said detector and said communication entity located externally from the vehicle: and said detector and said communication entity disposed at a location separated from the vehicle.

2. The device according to claim 1, wherein:

said detector has a sensor entity for registering the vehicle and a sensor control unit for controlling said sensor entity in order to register the vehicle multiple times in temporal succession; and said detector has a processing entity configured to determine the change in location based on sensor images corresponding to the vehicle having been registered multiple times.

3. The device according to claim 2, wherein said sensor entity has at least one sensor selected from the following group of sensors: radar sensor, ultrasound sensor, infrared sensor and optical image sensor.

4. The device according to claim 1, which further comprises:

a detector control unit for controlling said detector;

said communication entity being configured to receive a detector control command over the communication network and forward it to said detector control unit, to permit said detector control unit to control said detector based on the received detector command.

5. The device according to claim 1, wherein said communication entity is configured to automatically communicate the detected change in location to the user over the communication network.

6. The device according to claim 1, wherein said communication entity is configured to communicate the detected change in location to the user over the communication network in response to a corresponding enquiry from the user.

7. The device according to claim 1, wherein said detector includes a sensor configured for emitting a signal towards the vehicle and configured for receiving the signal after being reflected from the vehicle.

8. The device according to claim 7, wherein said sensor is a radar sensor.

* * * * *